US005306072A

United States Patent [19]

Caldwell

[11] Patent Number: 5,306,072

[45] Date of Patent: Apr. 26, 1994

[54] MODULAR SEATING

[76] Inventor: John Caldwell, 1829 Warwick Rd., San Marino, Calif. 91108

[21] Appl. No.: 840,052

[22] Filed: Feb. 20, 1992

[51] Int. Cl.[5] ..... A47C 15/00

[52] U.S. Cl. ..... 297/232; 297/248; 297/249; 297/440.1

[58] Field of Search ..... 247/232, 249, 440, 445, 247/248, 442; 297/411

[56] References Cited

U.S. PATENT DOCUMENTS

| | | | |
|---|---|---|---|
| 874,203 | 12/1907 | Jackson | 297/445 X |
| 3,990,741 | 11/1976 | Snyder et al. | 297/248 |
| 4,060,277 | 11/1977 | Leib | 297/248 |
| 4,154,476 | 5/1979 | Bloda | 297/248 |
| 4,494,796 | 1/1985 | Liebhold | 297/440 |
| 4,643,479 | 2/1987 | Servi | 297/440 X |

FOREIGN PATENT DOCUMENTS

| | | | |
|---|---|---|---|
| 2836667 | 3/1980 | Fed. Rep. of Germany | 297/440 |
| 1075006 | 10/1954 | France | 297/445 |
| 1249540 | 11/1960 | France | 297/440 |
| 0653247 | 2/1963 | Italy | 297/440 |
| 7811186 | 5/1980 | Netherlands | 297/248 |
| 0836488 | 6/1960 | United Kingdom | 297/248 |

*Primary Examiner*—Peter R. Brown
*Assistant Examiner*—Milton Nelson, Jr.
*Attorney, Agent, or Firm*—Donald D. Mon

[57] ABSTRACT

A modular article of furniture which has a right hand element and a left hand element, each being a rigid U-shaped arch with a pair of downwardly-extending legs, and a bight joining the legs. A pair of parallel shear members are integrally and rigidly connected to each of the legs, the members of each pair being one above the other. The shear members are joined by a splice, and an interconnecting member joins them for in-plane stability against tilting of the right hand element and left hand element.

12 Claims, 6 Drawing Sheets

FIG. 1
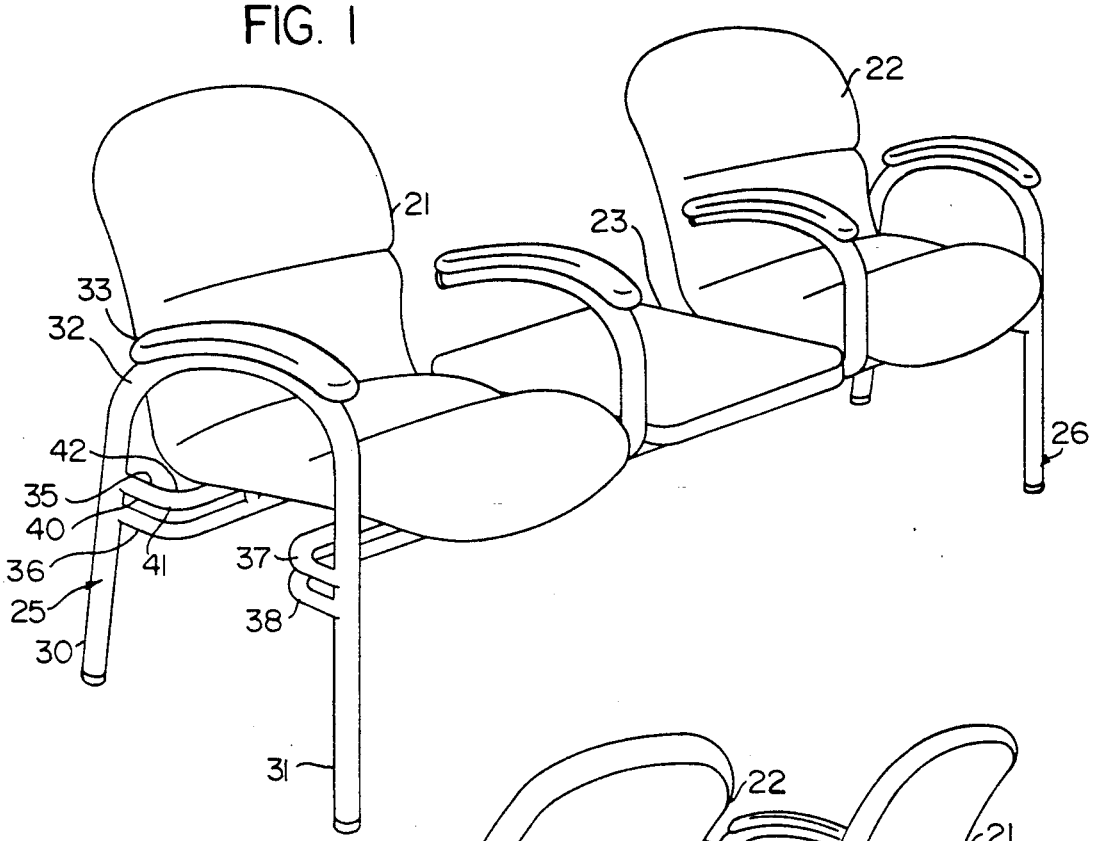
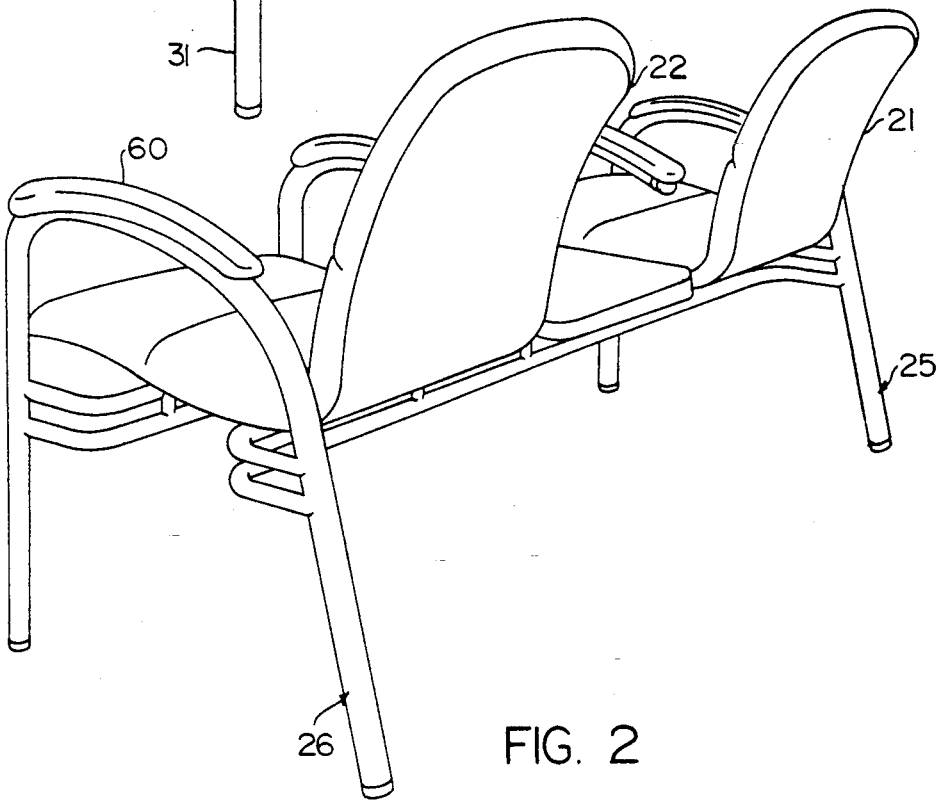
FIG. 2

MODULAR SEATING

FIELD OF THE INVENTION

This invention relates to modular seating constructions which from a minimum number of basic parts can be assembled to provide seating for from one to many persons, with the capacity to interpose optional amenities such as table tops.

BACKGROUND OF THE INVENTION

Places such as clinic waiting rooms and airport terminals require furniture for comfortably seating as many persons as possible in a minimum area. Also, it is useful to provide the furniture in modules so that an assembly of standardized parts can be configured to fit into areas of various sizes and shapes, and to incorporate such amenities as are desired, such as seats and table tops.

These objectives have been faced and are met by prior modular constructions. However, mere capacity and conformability are not sufficient for facilities where the proprietors also wish to provide a more welcoming look, lightness of appearance, lightness of actual weight, convenience for cleaning beneath the furniture, and maximum freedom of movement for the occupant, especially of his legs.

It is an object of this invention to provide modular furniture which provides optimal occupancy of the area it occupies, an impression of airy-ness, a lightness of weight with optimal strength, and minimal occlusion which could impede cleaning beneath the furniture, and which enables the occupant to retract his legs conveniently beneath his seat. This latter feature is of considerable advantage and comfort to a person who must wait for an extended period of time.

Further, it is an object of this invention to provide means for ready attachment of the amenities in an unobtrusive manner.

The furniture of this invention meets all of the above objectives, and provides, to the extent possible in such facilities, a most pleasant, convenient and comfortable seating.

BRIEF DESCRIPTION OF THE INVENTION

A modular article of furniture has a left hand and a right hand element. Each element is formed as a rigid arch with a pair of legs and an interconnecting bight. A pair of parallel shear members are rigidly attached to each leg. These are rigid elongated members with a first arm attached to its respective leg and directed toward the opposite leg of the arch, and a second arm directed laterally away from the plane of the arch. The shear members of each pair are spaced apart, one above the other, with a rigid member interconnecting them so as to provide for inplane shear resistance against sideward tilting.

Splice means is adapted rigidly to interconnect the ends of the second arms for assembly of the article of furniture.

According to a preferred but optional feature of the invention, the right hand and left hand elements are mirror images of one another.

According to yet another preferred but optional feature of the invention, one of the second arms of each pair is provided with support tabs for attachment of amenities such as seats and table tops.

According to still another optional feature of the invention, support tabs are provided on the splice means for attachment of amenities such as seats and table tops.

The above and other features of this invention will be fully understood from the following detailed description and the accompanying drawings, in which;

BRIEF DESCRIPTION OF THE DRAWINGS

FIG. 1 is a front oblique perspective view of one embodiment of the invention.

FIG. 2 is a rear oblique perspective view of the embodiment of FIG. 1;

DETAILED DESCRIPTION OF THE INVENTION

Figure 3:
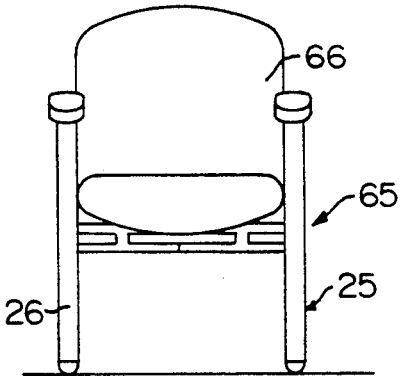
FIGS. 3–6 are front elevation views of four different embodiments which utilize single or multiple amenities.

FIGS. 1 and 2 show a modular article of furniture 20 that provides as amenities two seats 21 and 22, and a table top 23. As will later be seen, there are many variations of arrangements of amenities, from as few as only one, for a single chair, to a much larger number of chairs and table tops appropriate to available space in a waiting room.

In this description, the terms right and left will relate to the hands of a person seated on the furniture. The article includes a right hand element 25 and a left hand element 26. In FIGS. 1 and 2 these are the mirror images of one another, so that only right hand element 25 will be described in detail.

Right hand element 25 is made of rigid material, steel tubing being a good example. It is formed as an arch with two legs 30, 31, whose lower ends are intended to rest on a surface such as a floor. A bight 32 continuously connects the legs. The bight is adapted to receive an arm rest or pad 33.

A pair of rigid shear members 35, 36 are rigidly fixed to leg 30. Another pair of shear members 37, 38 are rigidly fixed to leg 31. The attachment may conveniently be by weldments.

Figure 11:
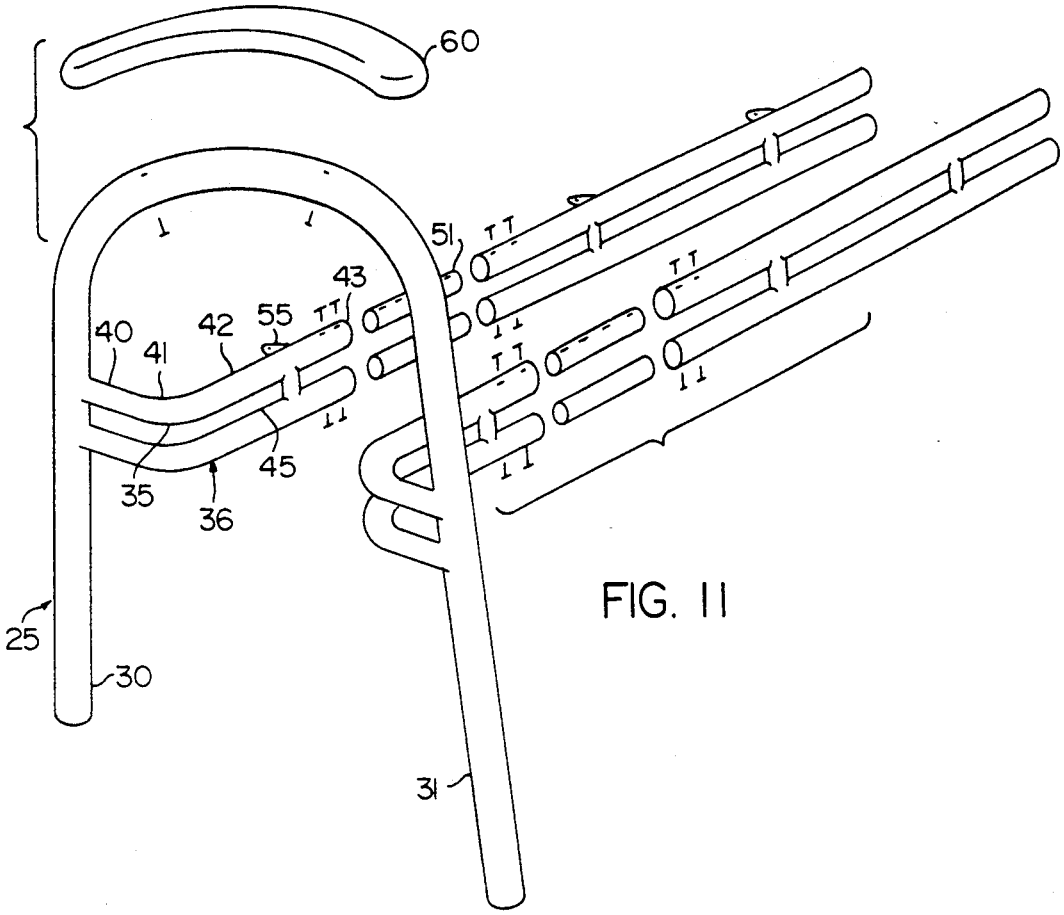
FIG. 11 is an exploded perspective view of an end element, and splice means.
Figure 12:
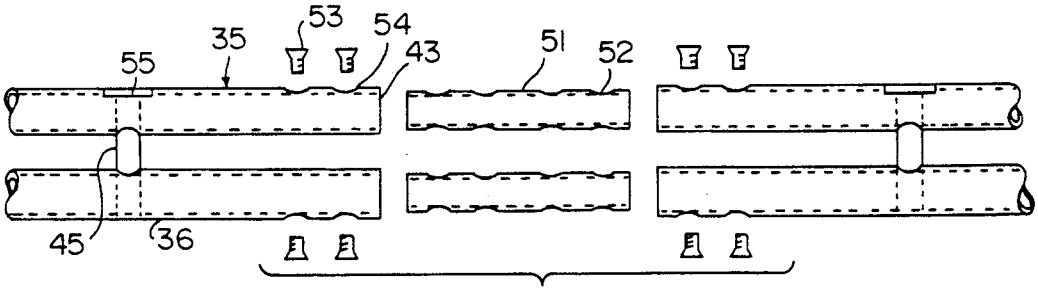
FIG. 12 is an exploded view of the joinder means for the second arms to the splice means.
Figure 13:
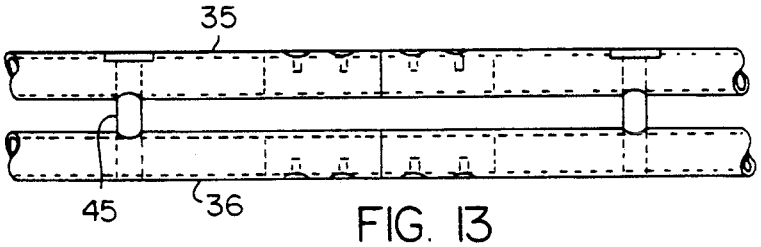
FIG. 13 shows the means of FIG. 12, assembled.

All of the shear members are substantially identical, so that only shear members 35 and 36 will be described in detail. Members 35 and 36 are parallel to one another, and are spaced one above the other, so that when the legs rest on the floor they are vertically disposed relative to one another. Each has a first arm 40 fixed to the leg, and extending generally in the plane of the arch. A bend 41 leads to a second arm 42, which has an end 43. As best shown in FIGS. 11, 12, and 13, a rigid interconnecting member 45 rigidly interconnects members 35 and 36. The second ends extend generally laterally to the plane of the arch, preferably normally to it.

Should only a single chair 50 be desired, such as shown in FIG. 3, the right hand and left hand elements will be joined by a short splice 51, such as is shown in FIGS. 11, 12 and 13. Best construction is to make the arches and shear members of steel or aluminum tubing. The simplest splice 51 will make a slip fit into the ends of the second arms. This is sometimes called a "trombone-type" fit. The outer surface of the splice is recessed with grooves 52 so that screws 53 can be threaded into threaded holes 54 and into the grooves to engage the splice and hold the furniture together. Suitable lengths and thicknesses of material will be provided. Is is evident that instead of an inside fit, the splice could make an outside fit with an arm which is either tubular or solid. In the illustration, the splice could be either tubular or solid.

Tabs 55 can be formed on the upper ones of the shear members to which amenities can be attached for support by the assembled structure.

An arm rest 60 can be attached to the bight of the arch if desired.

The assembly described above is sufficient to form a single chair 65 shown in FIG. 3, in which the single amenity is a seat 66. Identical reference numbers are used for the end elements in all description herein.

Figure 4:
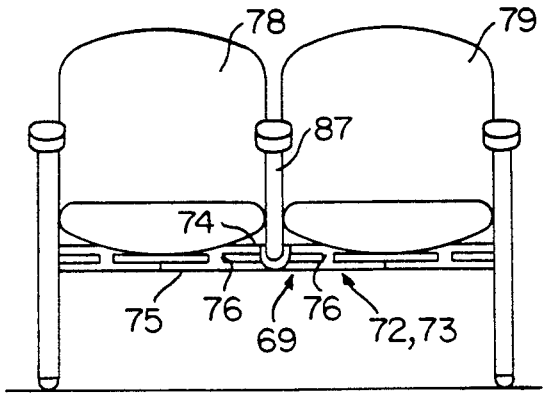

To form the two seat combination as shown in FIG. 4, the splice 69 includes two plug-like members identical to splice 51, and a pair of splice extenders 72, 73 (sometimes called "rigid elongated splice members"). The extenders are formed of two tubes 74, 75 which are connected to the second ends of the shear members. Rigid members 76 interconnect tubes 74 and 75 to provide the desired shear resistance. Pads are provided for mounting amenities. In the embodiment of FIG. 4, the amenities are two seats 78, 79.

Figure 5:
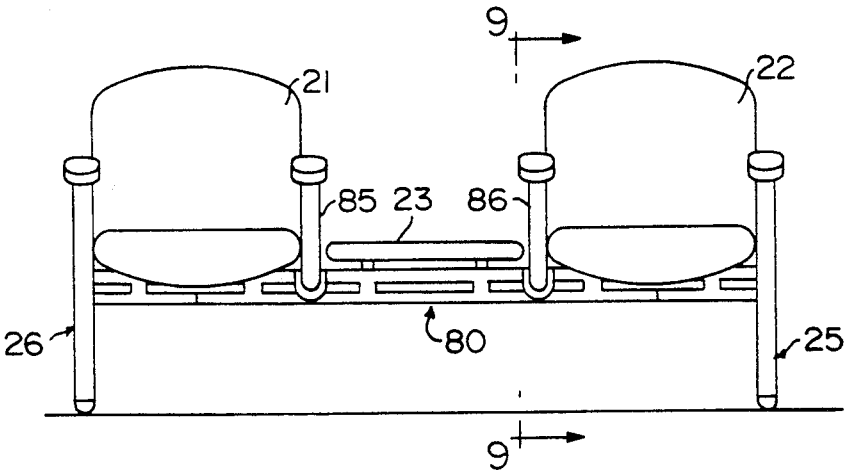

FIG. 5 is a further showing of the embodiment of FIGS. 1 and 2. In this embodiment there are two seats 21 and 22 and a table 23. Splice extenders 80, either a longer length than extenders 72 and 73, or a plurality of them may instead by used. Pads are provided on them for mounting purposes.

Figure 9:
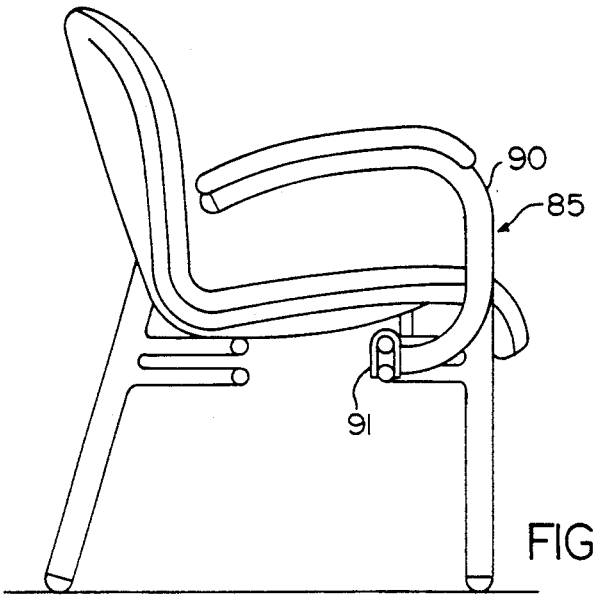
FIG. 9 is a cross-section taken at line 9—9 in FIG. 5.

The amenities include a pair of arm rests 85, 86, which are typical of additional arm rests in all of the other embodiments, such as arm rest 87 in FIG. 4. A typical arm rest 85 is shown in FIG. 9. A bent arm 90 is welded to a U-shaped bracket sometimes called a "downwardly-facing channel member 91 which fits over the splice to hold the arm rest to the assembled furniture.

Figure 6:
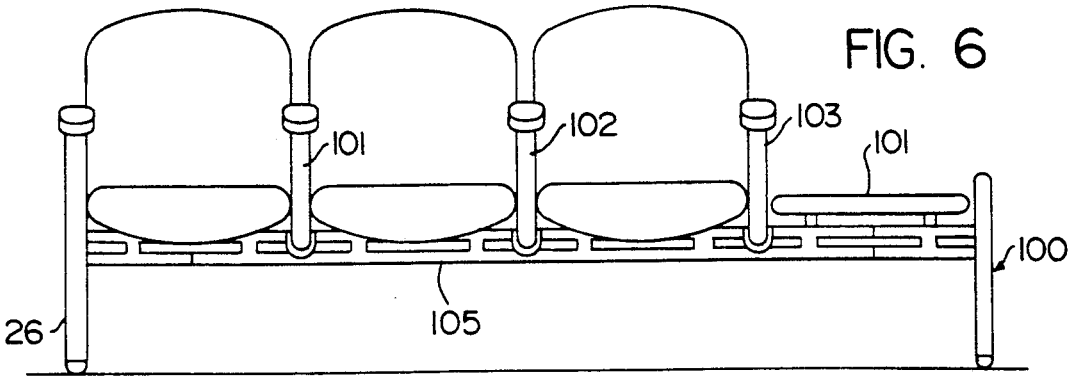

FIG. 6 shows a variation of an end element 100. It is the same as end elements 25 or 26, except that it is lower, so as to give better access to table top 101. Typical arm rests 102, 103, 104 are fitted to splice 105. The seats are fitted as before.

Figure 7:
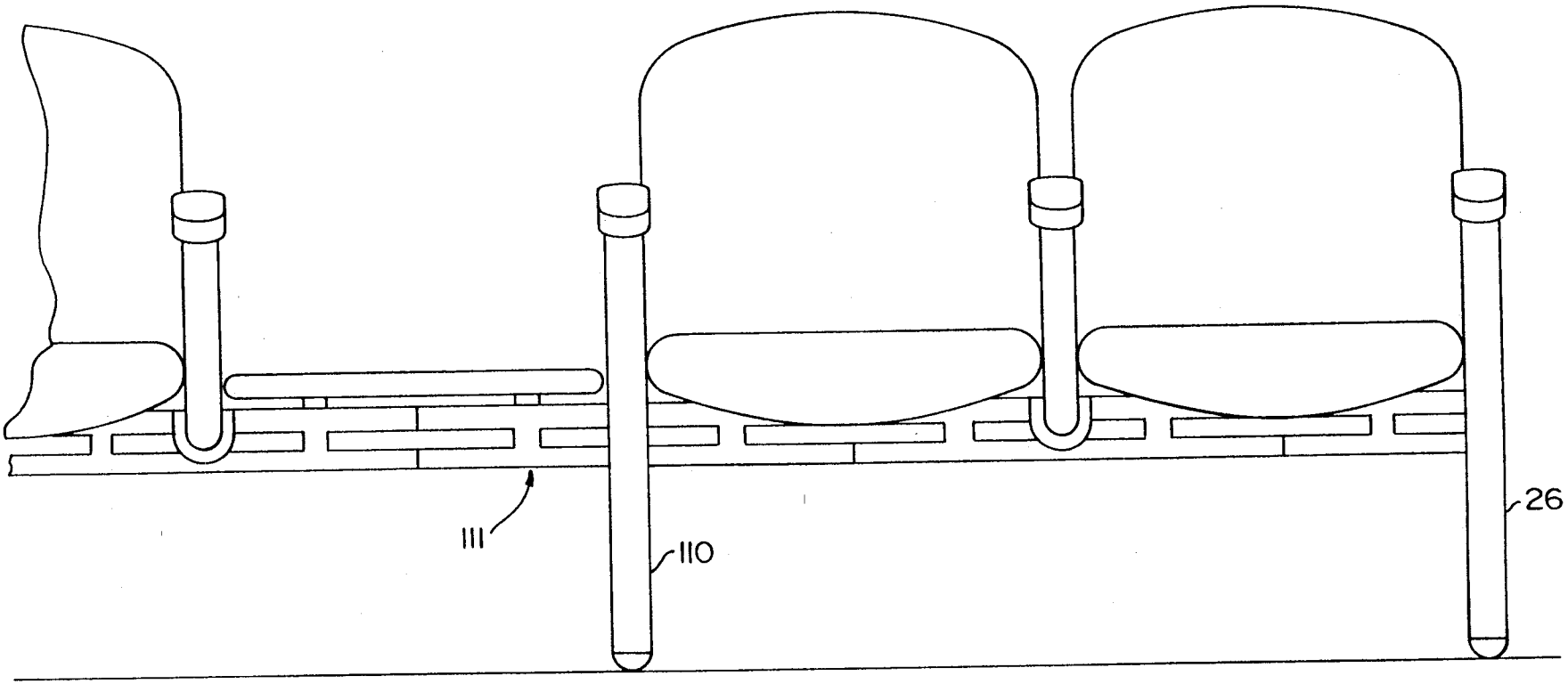
FIG. 7 is a fragmentary front elevation of another grouping showing an additional type of end element.
Figure 14:
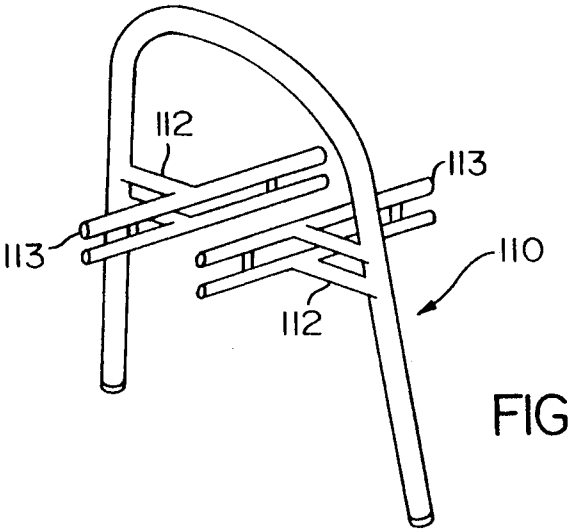
FIG. 14 is a perspective view of an intermediate leg member for the splice.

FIGS. 7 and 14 show an intermediate leg member 110 which forms part of a splice 111, when the span length of the assembly calls for additional support. As best shown in FIG. 14, it is provided with cross-members 112 and spike-like rigid members 113 which fit into splice extenders or into the second ends of the shear members as appropriate.

Figure 8:
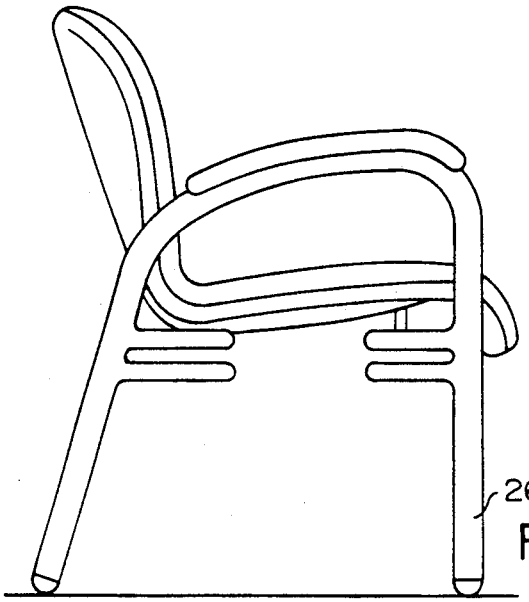
FIG. 8 is a right side elevation of FIG. 1, the left side elevation being the mirror image thereof.
Figure 10:
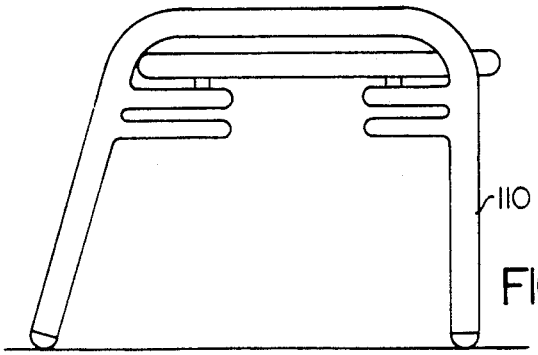
FIG. 10 is a right side elevation of FIG. 6, showing only the end element and the table top.

FIGS. 8 and 10 show end elements 26 and 100 in more detail.

Figure 15:
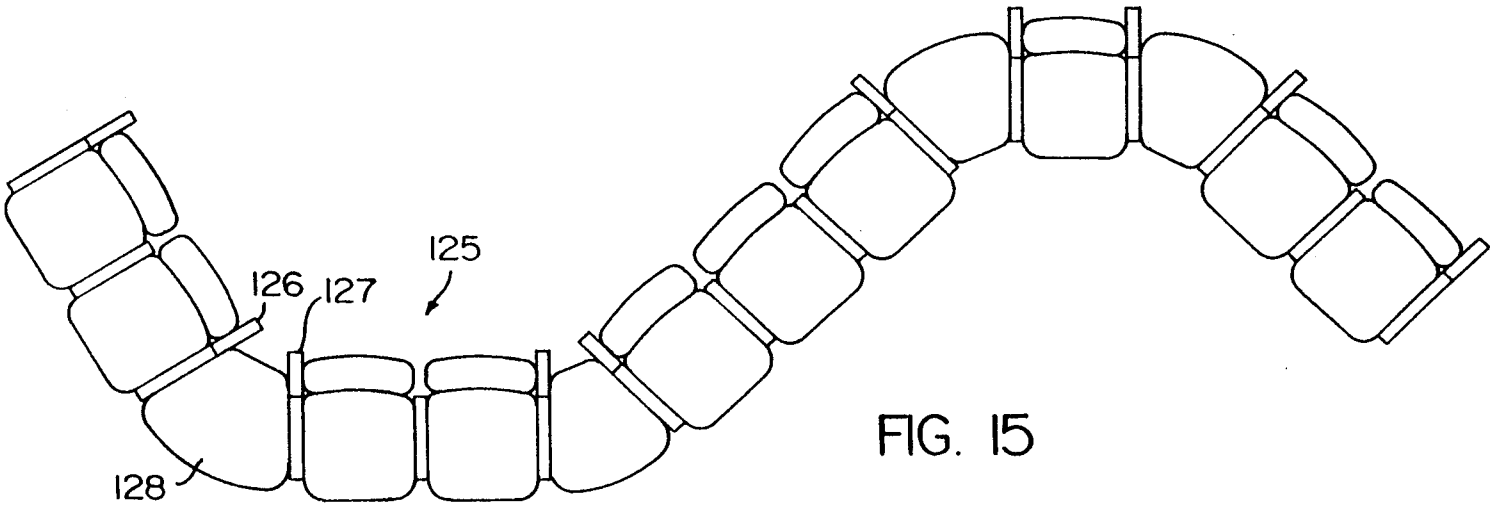
FIG. 15 shows a non-linear embodiment.

If non-linear arrangements such as the serpentine arrangement 125 of FIG. 15 are desired, then intermediate leg members 126, 127 like member 110 will be included in the splice for stability.

If an angled table 128 is desired, the table itself will be provided with means for joining to the leg member, and itself will form the bend.

It will be seen that a wide variety of configurations can be made from a very few parts, and that the resulting furniture has all of the advantages enumerated above.

This invention is not to be limited by the embodiment shown in the drawings and described in the description, which are given by way of example and not of limitation, but only in accordance with the scope of the appended claims.

I claim:

1. A modular article of furniture comprising:

a left hand and a right hand element, each said element comprising a rigid U-shaped arch with a pair of downwardly-extending legs adapted to rest on a surface, a bight interconnecting said legs, a pair of parallel shear members integrally and rigidly connected to each of said legs, said shear members each having a first arm rigidly joined to one of said legs and directed toward the other of said legs and a second arm directed laterally from the plane of the arch, the members of each pair of shear members being spaced apart one member above the other member;

a rigid interconnecting member interconnecting said second arms, whereby to provide in-plane shear resistance to relative movement of the second arms;

splice means for rigidly engaging ends of the second arm of said shear members whereby when said end members are joined by said splice means the arches form standing ends for the article of furniture, and the shear members provide support for furniture amenities and also provide resistance to sideward tilting of said left hand and right hand elements.

2. A modular article according to claim 1 in which the height of one of said elements is shorter than the other of said elements in order to provide for more convenient approach to an adjacent amenity such as a table top.

3. A modular article according to claim 1 in which an intermediate leg member is incorporated in said splice means to give further support to the splice means.

4. A modular article according to claim 1 in which the right hand and the left hand elements are mirror images of one another.

5. A modular article according to claim 1 in which said shear members are tubular, and which make a slip fit connection with said splice means.

6. A modular article according to claim 5 in which support tabs are incorporated in the upper ones of said second arms to which said amenities can be attached.

7. A modular article according to claim 1 in which said splice means comprises a pair of spaced apart rigid elongated splice members which are rigidly joined together by a rigid interconnecting member, said splice means thereby spacing apart said right hand and left hand elements to provide space for additional amenities.

8. A modular article according to claim 7 in which the second arms are tubular. and which make a slip fit connection with said splice means.

9. A modular article according to claim 7 in which said amenities are attached to said splice means.

10. A modular article according to claim 7 in which an arm member is fitted to said splice means, said arm member including a downwardly facing channel member fitted to said splice means.

11. A modular according to claim 4 in which a pair of seats are attached each to one of said elements and to splice means.

12. A modular article according to claim 11 in which an arm member is fitted to said splice means, said arm member including a downwardly facing channel member fitted to said splice means.

* * * * *